US012604935B2

(12) United States Patent
Brand

(10) Patent No.: US 12,604,935 B2
(45) Date of Patent: Apr. 21, 2026

(54) PROTECTIVE GARMENT FOR INFANT CARE

(71) Applicant: The Camel Corps, LLC, Ringoes, NJ (US)

(72) Inventor: Megan Brand, Ringoes, NJ (US)

(73) Assignee: The Camel Corps, LLC, Scottsdale, AZ (US)

( * ) Notice: Subject to any disclaimer, the term of this patent is extended or adjusted under 35 U.S.C. 154(b) by 0 days.

(21) Appl. No.: 18/648,443

(22) Filed: Apr. 28, 2024

(65) Prior Publication Data

US 2025/0331584 A1 Oct. 30, 2025

(51) Int. Cl.
*A41D 13/04* (2006.01)

(52) U.S. Cl.
CPC ..... *A41D 13/04* (2013.01)

(58) Field of Classification Search
CPC ..... A41D 13/04
USPC ..... 2/48, 49.1, 46
See application file for complete search history.

(56) References Cited

U.S. PATENT DOCUMENTS 1,432,249 A * 10/1922 Hoyme ..... A41D 7/008 2/48
3,587,952 A * 6/1971 Higuchi ..... A47D 13/025 224/160
3,815,153 A * 6/1974 Vitol ..... A41D 13/04 206/278
5,956,762 A * 9/1999 Adams ..... A41D 1/215 2/48
7,269,855 B2 * 9/2007 LaRocco ..... A41B 13/103 2/49.1
2006/0021106 A1 * 2/2006 Snodgrass ..... A41D 13/04 2/48
2006/0090237 A1 * 5/2006 Dabney ..... A41D 13/04 2/48
2009/0205098 A1 * 8/2009 Araquistain ..... A45D 44/08 2/48
2011/0296577 A1 * 12/2011 Jackson, Jr. ..... A41D 13/04 2/48
2013/0219580 A1 * 8/2013 Garrels ..... A41D 13/04 2/48
2019/0335825 A1 * 11/2019 Green ..... A41D 13/0012
2019/0357607 A1 * 11/2019 Carter ..... A41D 13/129
2020/0329791 A1 * 10/2020 McAteer ..... A41D 13/04

* cited by examiner

*Primary Examiner* — Alissa L Hoey
*Assistant Examiner* — Akwokwo Olabisi Redhead
(74) *Attorney, Agent, or Firm* — Hopkins IP, LLC; Edward W. Yee

(57) ABSTRACT

A garment is described herein, where the garment may be worn by a caregiver of an infant and is constructed to cover the caregiver and his or her clothing from reflux from the infant. The garment comprises a single rectangular layer of fabric and a strap having an upper end and a lower end, wherein the upper end is attached to the upper attachment point on a right edge of the fabric, and the lower end is attached to a lower attachment point on the right edge of the fabric, wherein the strap is located off-center on the right edge of the fabric, closer to an upper edge of the fabric than to a lower edge of the fabric, and is configured to be placed over the head of the wearer.

10 Claims, 4 Drawing Sheets

PROTECTIVE GARMENT FOR INFANT CARE

This application claims the benefit of U.S. Provisional Patent Application Ser. No. 63/471,852, which is incorporated herein by reference in its entirety.

FIELD OF THE INVENTION

The invention described herein relates to protective clothing for a caregiver of an infant.

BACKGROUND ART

Infant children are known to regurgitate, as is known to any caregiver. If the baby is being held by a caregiver, the reflux typically lands on the clothing of the caregiver unless some protective measures are taken. Such measures may include a towel or other piece of fabric placed on the caregiver's shoulder if the baby is being held with his/her face at that shoulder.

Such measures offer limited protection to the caregiver's clothes. A towel covers only a limited region, and reflux may easily land or drip on an unprotected area of clothing. A towel or receiving blanket falls off when the caregiver moves around or leans over. Over time while wearing, towels bunch up covering an even smaller area.

What is needed is a covering that more effectively protects the clothing of a caregiver when a baby regurgitates.

BRIEF DESCRIPTION OF THE DRAWINGS/FIGURES

Further embodiments, features, and advantages of the present invention, as well as the operation of the various embodiments of the present invention, are described below with reference to the accompanying drawings.

DETAILED DESCRIPTION OF THE INVENTION

A preferred embodiment of the present invention is now described with reference to the FIGURES. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other systems and applications.

Figure 1:
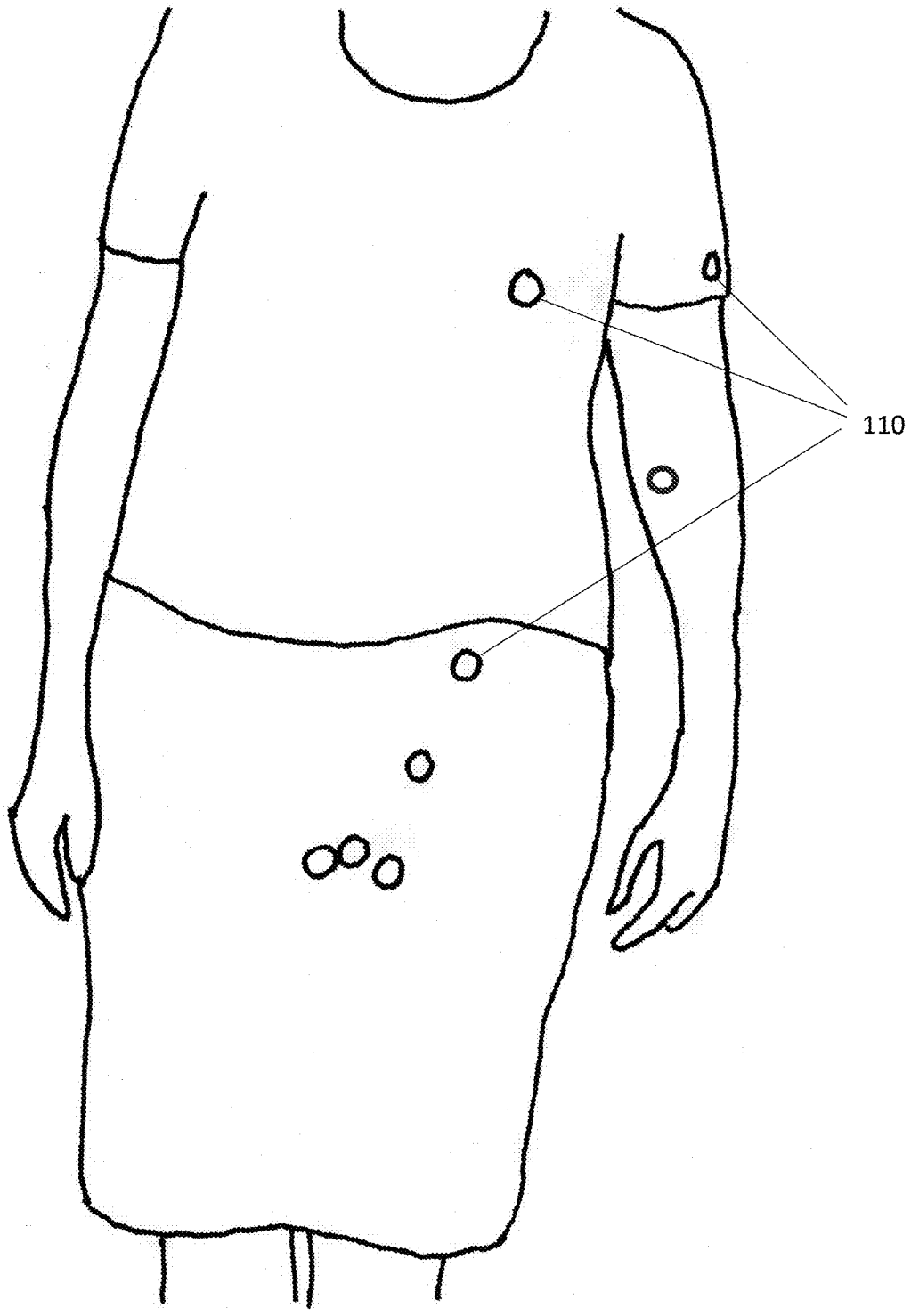
FIG. 1 illustrates the locations at which infant reflux may land on the clothing of a caregiver.

FIG. 1 illustrates locations on a caregiver's clothing where a baby's reflux can land, assuming that the baby is being held at the left shoulder of the caregiver. These locations, such as location 110, are indicated by markers. Note that there is a well-known tendency for caregivers to hold an infant at the left shoulder, sometimes known as "left-cradle bias", and in this scenario the reflux is prone to landing on the left side of the caregiver's clothing as is evident in FIG. 1. For this reason, an embodiment of the invention provides more coverage of the caregiver's left side than the right.

Figure 2:
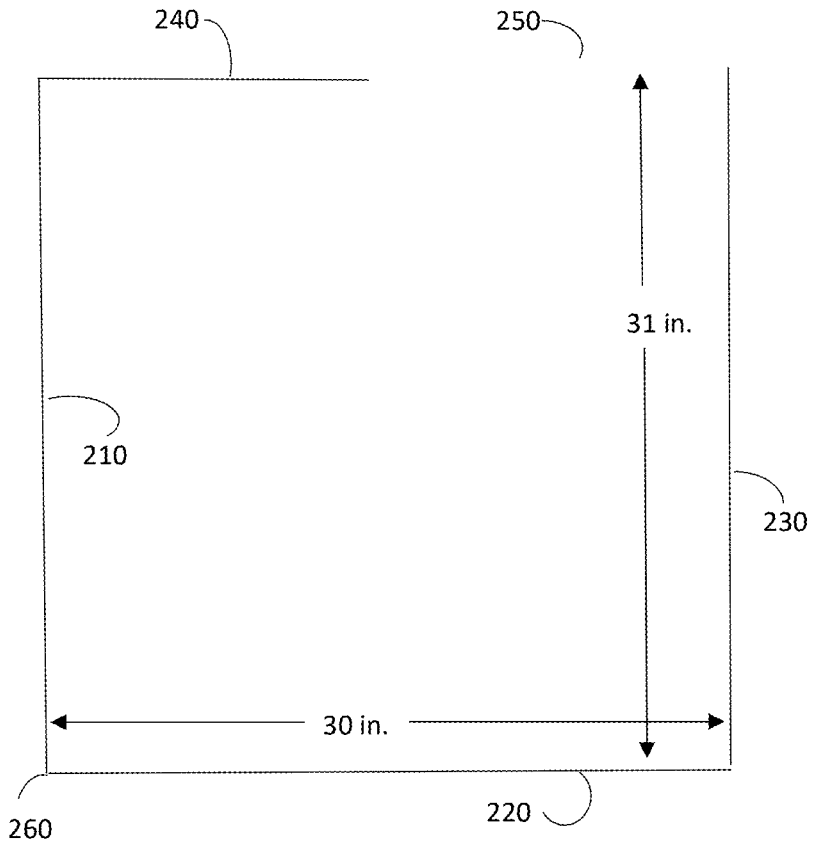
FIG. 2 illustrates a garment that may cover areas most likely to need protection, according to an embodiment.

FIG. 2 illustrates an embodiment of the protective garment. The garment may have two parallel layers that are largely identical and cover the front and back of the caregiver respectively. In an embodiment, these two layers may be separate and similar pieces of fabric that are sewn together. Alternatively, the garment may be made of a single piece of fabric that is folded along edge 230 to create two layers.

FIG. 2 shows the front side of the garment, which covers the front of the caregiver. There is an opening 250 that is left unsewn and through which the caregiver's head may go, on the left portion of the upper edge. The right portion of this edge may be closed. Edge 220 is open, in that the front and back layers are not sewn or otherwise connected along this edge. Edge 230 is on the caregiver's left side and may be closed at least along a portion of its length. Edge 210 may be open or partially open to allow use of the right arm. Edge 240, which extends partially along the top of the fabric layers, is sewn or otherwise closed and can cover the right shoulder of the caregiver. When worn, corner 260 may drape over the crotch area of the caregiver.

In an embodiment, the width of the garment as shown may be approximately 30 inches and its height may be approximately 31 inches. The exact dimensions may vary in different embodiments and may be made in different sizes to accommodate different users. In various embodiments, the width may be 28 to 33 inches and the height may be 29-33 inches for example and without limitation. It is an objective of the invention that, when worn, the garment be long enough to protect the crotch region of the caregiver.

Moreover, the embodiment of FIG. 2 shows the front of the garment for a caregiver that tends to support the infant at or near his/her left shoulder. If the caregiver is more prone to using his/her right shoulder, a symmetrically reversed embodiment may be used. Alternatively, one garment may be used for both cases by turning the garment front-to-back as necessary.

The fabric may be moisture resistant, moistureproof, or moisture repellant, to protect the caregiver from the child's reflux. A fabric that is moisture repellant but breathable may be preferred, to be more comfortable for the caregiver when worn. One example of a water repellant fabric is the Ventile cotton fabric with Durable Water Repellency, described at ventile.co.uk. Another example is the Whisper Poplin product, which includes a durable moisture repellant finish, described at carrtextile.com. In other embodiments the fabric may not require a durable moisture repellant finish; rather, the fabric may be thick and/or dense enough to have minimal seepage, so that the moisture does not readily reach the wearer. Fabric weighing approximately 220 grams per square meter (gsm) may be sufficient for this purpose. Long fibers, such as extra-long-staple cotton, that lengthen when wet, may provide a moisture barrier. Additionally, fabrics made with yarn garnered from high precision spinning and/or dense weaving may provide moisture resistant properties that protect clothing from reflux. It is to be understood that these are examples of possible fabrics that may be used for the garment, and are not meant to be limiting. Other embodiments of the garment may use other water repellant or waterproof fabrics.

Figure 3:
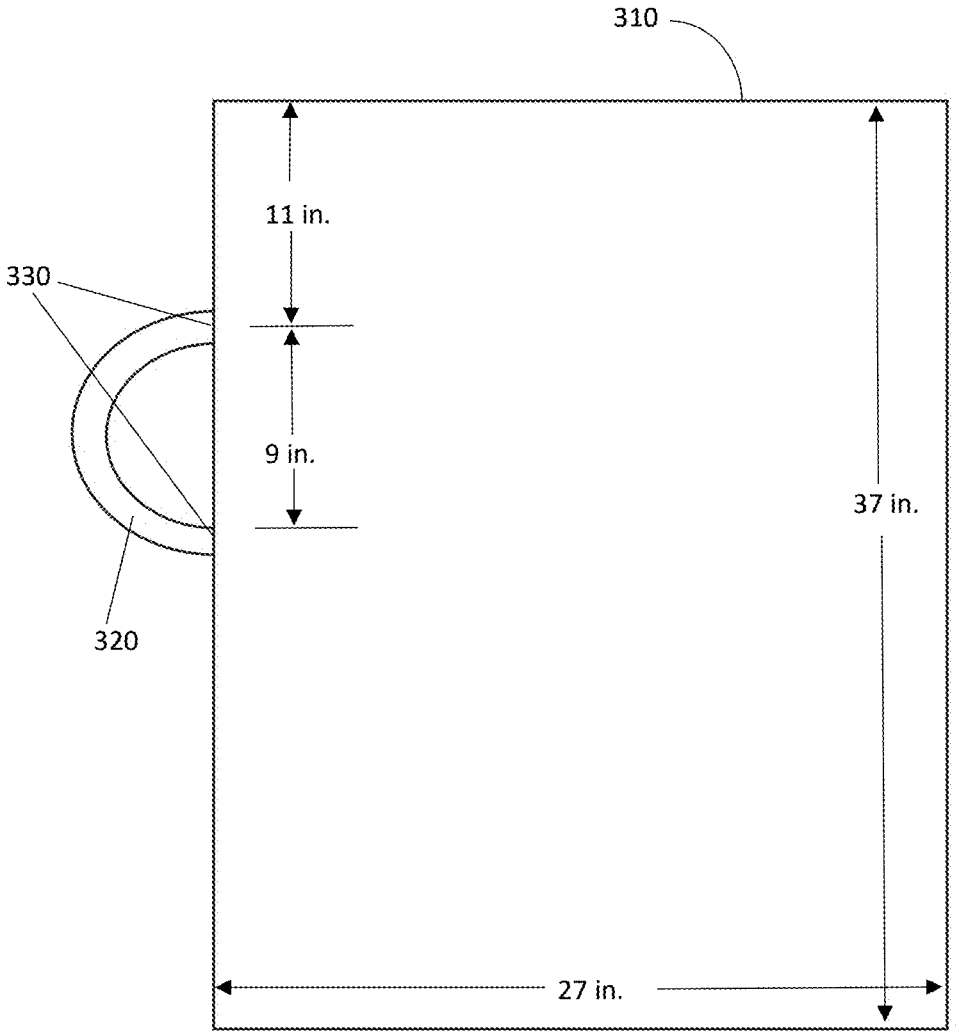
FIG. 3 illustrates a garment that may cover areas most likely to need protection, according to an alternative embodiment.

An alternative embodiment is shown in FIG. 3 in a frontal view. Here a single sheet of fabric, approximately rectangular, may be used to form garment 310. In this example, the garment is approximately 37 inches in height and 27 inches in width. In other embodiments, the garment may be from 35 to 39 inches in height and from 25 to 29 inches in width, for example and without limitation.

As before, the fabric may be moistureproof or moisture repellant, or include a durable moisture repellant finish to protect the wearer from the child's reflux. A fabric that is moisture repellant but breathable may be preferred, to be more comfortable for the caregiver when worn. Examples include the Whisper Poplin and the Ventile fabrics with Durable Water Repellancy noted above. In other embodiments the fabric may be thick and/or dense enough to limit seepage, so that the moisture does not immediately reach the wearer. Fabric weighing approximately 220 grams per square meter (gsm) may be sufficient for this purpose.

A strap 320 is provided, through which the wearer may place his or her head. The configuration of this embodiment results in the upper portion of garment 310 being draped over the wearer's left shoulder. This allows the wearer to protect areas such as those shown in FIG. 1 while holding the infant at the left shoulder. The upper and lower ends of strap 320 may be attached to garment 310 at upper and lower attachment points 330. In the illustrated embodiment, the upper attachment point is approximately 11 inches below the upper edge of garment 310, and the lower attachment point is approximately 9 inches below the upper attachment point. In various embodiments, the upper attachment point may be 9 to 13 inches from the upper edge of garment 310, and the lower attachment point may be 7 to 11 inches below the upper attachment point.

The strap 320 may be made of the same material as garment 310 or may be made of a different material. Strap 320 may be approximately 24 inches in length. In an embodiment, strap 320 may be adjustable in length using D-rings or any other mechanism known in the art. The garment 310 may also be reversible, so that the wearer may instead cover the right shoulder if holding the infant on that side.

Figure 4:
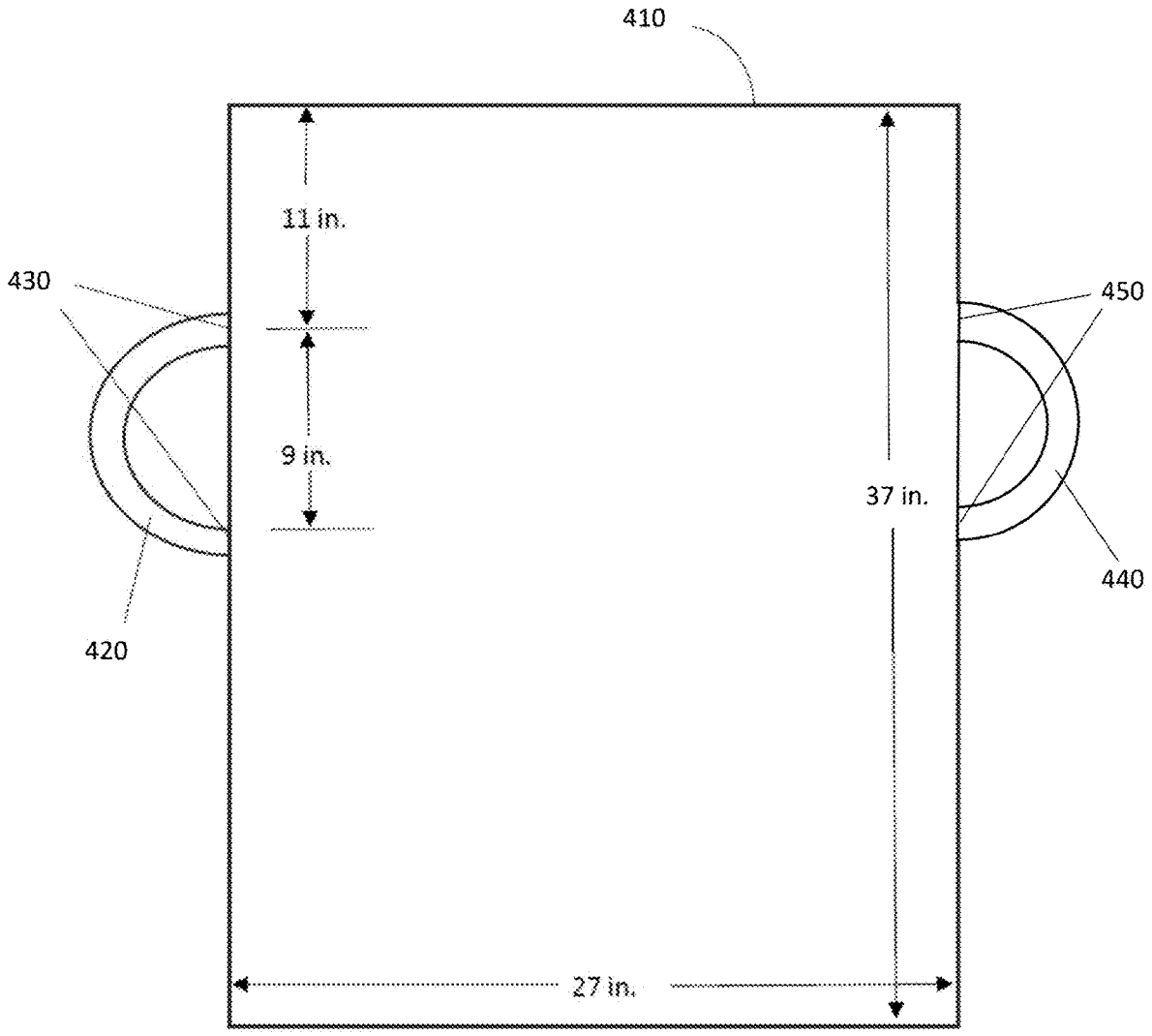
FIG. 4 illustrates a garment that may cover areas most likely to need protection, according to an alternative embodiment.

An alternative embodiment is shown in FIG. 4, featuring two straps 420 and 440 on either vertical edge of garment 410. Construction of the garment here is otherwise the same as that shown in FIG. 3. Straps 420 and 440 both may be approximately 24 inches in length and may be adjustable in length using D-rings or any other mechanism known in the art. Placement of the straps may be symmetrical. The second strap 440, like the first strap 420, may have two attachment points that are shown here as points 450. For each strap, the upper attachment point is approximately 11 inches below the upper edge of garment 410, and the lower attachment point is approximately 9 inches below the upper attachment point.

By having two straps 420 and 440, the wearer may be able to use either one. Placing his/her head through strap 420, the upper portion of the garment 410 may be draped over the left shoulder, allowing the infant to be held at that shoulder. Placing his/her head through strap 440, the upper portion of the garment 410 may be draped over the right shoulder, allowing the infant to be held at that shoulder. This gives the wearer flexibility to use either shoulder.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

I claim:

1. A garment for protecting a wearer's clothing from an infant's reflux, the garment comprising:

a rectangular layer of fabric; and a strap having an upper end and a lower end, wherein the upper end is attached to an upper attachment point on a right edge of the rectangular layer of fabric, and the lower end is attached to a lower attachment point on the right edge of the rectangular layer of fabric, wherein the strap is located off-center on the right edge of the rectangular layer of fabric, closer to an upper edge of the rectangular layer of fabric than to a lower edge of the rectangular layer of fabric, and is configured to be placed over the head of the wearer.

2. The garment of claim 1, wherein the garment is made of a moisture resistant fabric.

3. The garment of claim 1, wherein the garment is made of a fabric having a durable water repellant finish.

4. The garment of claim 1, wherein the garment is between 25 and 29 inches in width.

5. The garment of claim 1, wherein the garment is between 35 and 39 inches in height.

6. The garment of claim 1, wherein the upper attachment point is between 9 and 13 inches from the upper edge of the fabric as measured along the right edge.

7. The garment of claim 6, wherein the lower attachment point is between 7 and 11 inches below the upper attachment point, as measured along the right edge.

8. The garment of claim 1, wherein the strap is 22-26 inches in length.

9. The garment of claim 1, wherein the strap is adjustable in length.

10. The garment of claim 1, further comprising a second strap attached to a left edge of the fabric, symmetrically opposite the strap on the right edge.

* * * * *